United States Patent [19]

Vincent et al.

[11] 4,379,298

[45] Apr. 5, 1983

[54] TUNABLE CITIZEN BAND ANTENNA

[75] Inventors: Richard G. Vincent, Mesa; Frank Sacks; Robert F. Steele, both of Phoenix, all of Ariz.

[73] Assignee: PAL International, Phoenix, Ariz.

[21] Appl. No.: 285,267

[22] Filed: Jul. 20, 1981

[51] Int. Cl.[3] ..... H01Q 1/36

[52] U.S. Cl. ..... 343/895; 343/750

[58] Field of Search ..... 343/895, 715, 749, 750

[56] References Cited

U.S. PATENT DOCUMENTS

| | | | |
|---|---|---|---|
| 4,097,867 | 6/1978 | Eroncig | 343/750 |
| 4,101,898 | 7/1978 | Ingram | 343/895 |
| 4,137,534 | 1/1979 | Goodnight | 343/895 |
| 4,163,981 | 8/1979 | Wilson | 343/895 |
| 4,214,247 | 7/1980 | Richmond | 343/895 |

*Primary Examiner*—David K. Moore

*Attorney, Agent, or Firm*—Harry M. Weiss

[57] ABSTRACT

An improved tunable citizen band antenna includes an adjustable tuning assembly located at the tip of a wire wound fiberglass core antenna to lengthen or shorten the effective electrical length of the antenna, so that the antenna can be tuned to a specific, desired resonant frequency, resulting in enhanced antenna radiation, reception, and power transmission.

15 Claims, 4 Drawing Figures

TUNABLE CITIZEN BAND ANTENNA

BACKGROUND OF THE INVENTION

1. Field of the Invention

This invention relates generally to citizen band antennas and, more specifically, to a citizen band (CB) antenna including means for manually adjusting the electrical length of the antenna.

2. Description of the Prior Art

Citizen band antennas are designed to receive and transmit radio waves to and from a radio which operates within a specific range of audio frequencies. The purpose of the antenna is to achieve maximum radiation and reception of transmitted or received radio signals. Therefore, it is desirable to select an antenna whose natural or resonant frequency is tuned to the frequency of the radio waves that are to be transmitted and received by the user's radio.

In the past, CB antennas have been factory tuned to a frequency approximately in the middle of the citizen band frequency range. As a result, as the user operated a radio at a frequency that was within the citizen band range but deviated from the factory tuned resonant frequency, transmitting and receiving performance faltered due to the cancellation effect of the non-resonant frequencies carried on the antenna.

To help alleviate this problem, an improved type of antenna was designed wherein the antenna could be tuned to carry a specific harmonic within the operator's desired range of frequencies. This type of prior art usually comprised a metal whip antenna which could be physically lengthened or shortened by loosening a bolt and sliding a portion of the metal whip in or out of a coil housing. Whereas this type of antenna did indeed enhance frequency response, it exhibited loss of signal power due to material and series resistance along the length of the metal antenna.

Another type of antenna was introduced that greatly improved the reception and transmission response. Signal strength was increased by using a fiberglass core around which was wound a transmission wire tuned, as before, to a frequency in the middle of the desired range of use. This type of antenna carried a signal to the receiver with very little loss of signal strength. However, this was still a non-tunable antenna and suffered from a deficient frequency response.

The need existed to design a tunable CB radio antenna that would exhibit a desirable frequency response, while suffering minimal loss or compromise in signal strength.

SUMMARY OF THE INVENTION

In accordance with one embodiment of this invention, it is an object of this invention to provide an improved type of citizen band antenna.

It is a further object of the present invention to provide a tunable citizen band antenna which exhibits a good frequency response while at the same time exhibits minimal loss or compromise of signal strength.

It is a still further object of this invention to provide a tunable citizen band antenna wherein the antenna is tuned manually to a frequency desired by the operator within the citizen band frequency range.

Yet another object of this invention is to provide manually tunable citizen band antenna made of a material which is durable and exhibits low electrical resistance so as to efficiently transmit the desired frequency radio signals.

Finally, it is an object of this invention to provide a tunable citizen band antenna which is easily fabricated using current antenna fabrication methods.

Briefly described, a tunable citizen band antenna is disclosed wherein the antenna is comprised of a fiberglass core around which is wrapped a copper conductive transmission line, a brass tuning extender permanently mounted to the tip of the antenna core and to which the copper transmission wire is connected, a brass tuning screw threaded to fit into the tuning extender, a brass jam nut to lock in place the adjustable tuning screw, and a rubber "O"-ring mounted between the tuning extender and jam nut to reduce the detrimental effects of vibration.

The brass tuning extender is epoxied to a fiberglass core that has had its normal physical length, as compared to a non-tunable antenna, reduced by the physical length of the tuning extender. The other end of the fiberglass core is then epoxied to a male threaded metal base. A copper conductive wire is then wrapped from the base, around the core, to the extender, and soldered to make electrical contact to both the base and the extender. The brass jam nut is threaded onto the brass tuning screw, followed by the insertion of the tuning screw through a rubber "O"-ring. The tuning screw is threaded into the tuning extender. In this manner, the operator can physically adjust the electrical resonance, or frequency response, of the antenna assembly.

According to a broad aspect of the invention there is provided a tunable antenna, comprising: a flexible core; a conductive base member coupled to the bottom of the core; an upper conductive member coupled to the top of the core; a conductive transmission line wound around the core and coupled at opposite ends to the upper conductive member and to the conductive base member to complete a conductive path; and means coupled to the upper conductive member for varying the length of the conductive path.

The foregoing and other objects, features and advantages of the present invention will be apparent from the following, more particular, description of the preferred embodiments of the invention, as illustrated in the accompanying drawings.

BRIEF DESCRIPTION OF THE DRAWING

Referring to FIGS. 1 and 2, the tunable citizen band antenna is referenced generally by the number 10. The antenna is comprised of a fiberglass antenna core 12 to which is mounted a tuning assembly referenced generally by the number 11, a base 15, and a copper magnetic wire wrap 16.

Referring to FIG. 2, the tuning assembly 11 is comprised of a brass tuning extender 14, a brass tuning screw 18, a brass jam nut 20, and a rubber "O"-ring 22. The brass tuning extender 14 is epoxied to the tip 19 of the fiberglass antenna core 12, which is, in turn, epoxied at its bottom 13, to the male threaded base 15. The copper magnetic wire 16 is then soldered to the base 15, wrapped around the epoxied base junction 13, wound around the core 12 at various pitches (depending on design criteria), wrapped around the epoxied tip junction 19, and then soldered to the brass tip extender 14, hence completing the electrical path from the tunable antenna tip to its base. The brass jam nut 20 is then threaded onto the brass tuning screw 18. The rubber "O"-ring 22, which acts to absorb vibration that is translated to the tip 19 of the antenna core 12, is then positioned against brass jam nut 20 as shown. The brass tuning screw 18 is then threaded tightly into brass tuning extender 14 until stopped by the jam nut 20 and "O"-ring 22.

Referring to FIG. 3, by varying the depth that tuning screw 18 is threaded into extender 14, the effective length of the antenna 10 is increased or decreased. In this manner, the resonant frequency of the antenna, which is dependent on the effective electrical length of the antenna, is altered to fit the need of the user.

Figure 1:
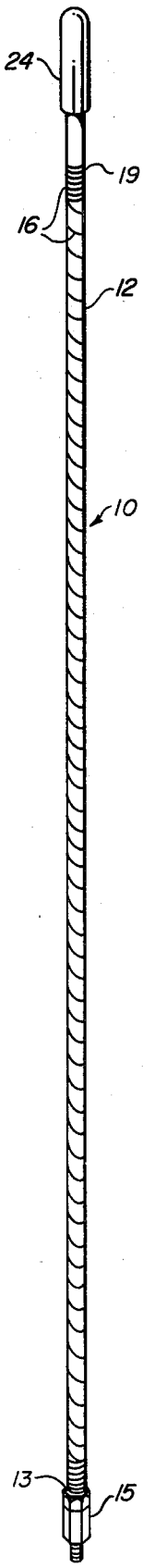
FIG. 1 is a plan view of a tunable CB antenna, according to the present invention.
Figure 2:
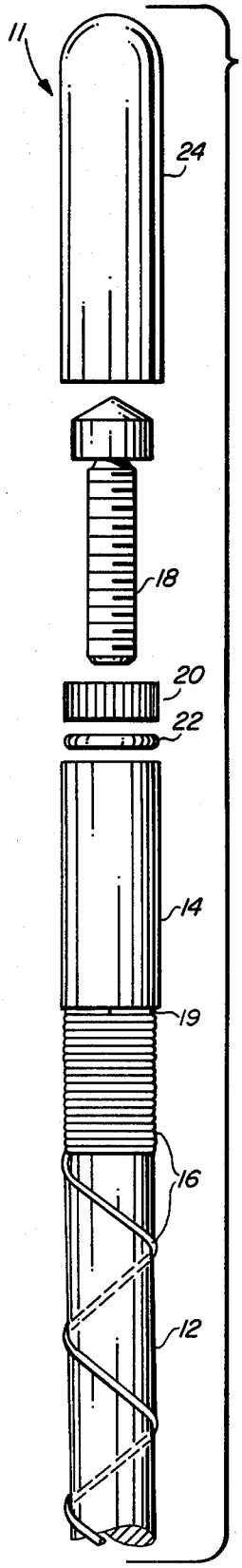
FIG. 2 is an expanded view of the antenna of FIG. 1 showing a tuning screw assembly mounted to a fiberglass core.
Figure 3:
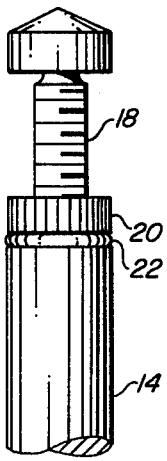
FIG. 3 is a plan view of the tuning assembly.

The antenna can be tuned using any well known method. For example, the user can take a VSWR reading of the installed antenna. This test measures the reflected power of the radio signals transmitted on the antenna. The brass tuning screw 18 and the brass jam nut 20 are then adjusted to lengthen or shorten the effective length of the antenna until a minimum VSWR reading is obtained. At this point, the tunable antenna 10 is set for optimum performance at a specific audio frequency.

The brass jam nut 20 and the shock absorbing rubber "O"-ring 22 assure that the tuning screw will not vibrate loose, thus preventing the loss of the desired tuned resonant frequency of the antenna. To further protect the tuning assembly 11 from detrimental effects of the environment, an optional tight fitting rubber tip 24 can be provided to seal the tuning assembly 11.

Figure 4:
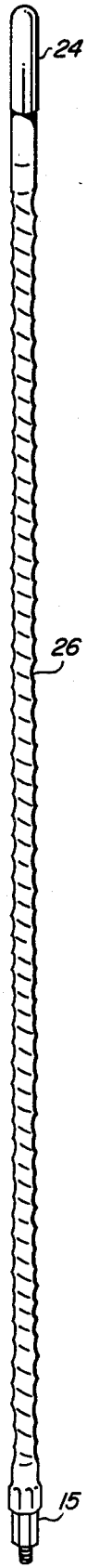
FIG. 4 is a plan view of the tuning antenna with a protective wrapping around the fiberglass core.

As shown in FIG. 4, in addition to the rubber tip 24, the antenna 26 is sealed in a high impact, wide temperature range polyolefin 26 so as to protect the copper magnetic wire and reduce static along the antenna.

While the invention has been particularly shown and described with reference to a preferred embodiment thereof, it will be understood by those skilled in the art that the foregoing and other changes in form and details may be made therein without departing from the spirit and scope of the invention. For example, by fitting the tunable tip of this invention to a four foot long citizen band antenna as described above, a radio operator would be able to expand the usable range (usually 26.965 MHz to 27.405 MHz) of a normal citizen band antenna to a range, for example, from 26.280 MHz to 29.520 MHz which is nearly 3 MHz greater in range than a fixed or non-tunable antenna. Thus, in this application, the tunable tip antenna provides a radio operator with the option of transmitting or receiving signals at frequencies outside of the citizen band frequency range. As a result, the tunable tip antenna is not only more efficient, but also much more versatile than the normal fixed citizen band antenna.

What is claimed is:

1. A tunable antenna comprised of:

a flexible core;

a conductive internally threaded tuning extender mounted to the top of said flexible core;

a conductive base mounted to the bottom of said flexible core;

a conductive wire forming an electrical path from said conductive base to said tuning extender;

a conductive externally threaded tuning screw threaded within said conductive tuning extender;

a conductive internally threaded jam nut coupled on said tuning screw; and a rubber "O"-ring mounted between said conductive jam nut and said conductive tuning extender.

2. A tunable antenna in accordance with claim 1 wherein said flexible core is of length sufficient to allow for transmission of required harmonics of a desired frequency radio signal, less the length of said conductive tuning extender.

3. A tunable antenna in accordance to claim 1 wherein said core is made of fiberglass.

4. A tunable antenna in accordance to claim 1 wherein said conductive tuning extender is coupled to said flexible core with epoxy.

5. A tunable antenna in accordance to claim 1 wherein said conductive tuning extender is fabricated of brass.

6. A tunable antenna in accordance with claim 1 wherein said conductive base is threaded so as to screw into a mounting base.

7. A tunable antenna in accordance with claim 6 wherein said conductive base is fabricated of brass.

8. A tunable antenna in accordance with claim 1 wherein said conductive wire is wound around said flexible core and connected to said conductive base and to said conductive tuning extender.

9. A tunable antenna in accordance with claim 8 wherein said conductive wire is wound around said flexible core at a predetermined pitch.

10. A tunable antenna in accordance with claim 1 wherein said conductive wire and said flexible core is sealed within a resilient, static eliminating material.

11. A tunable antenna in accordance with claim 10 wherein said sealing material is polyolefin.

12. A tunable antenna in accordance with claim 1 wherein said tuning extender and tuning screw are sealed within a protective glove.

13. A tunable antenna, comprising:

a flexible core;

a conductive base member coupled to the bottom of said core;

an upper conductive member coupled to the top of said core;

a conductive transmission line wound around said core and coupled at opposite ends to said upper conductive member and to said conductive base member to complete a conductive path; and rotatable tuning means having a conductive electrical coupling to said upper conductive member for varying the length of said conductive path.

14. An antenna according to claim 13 wherein:

said upper member comprises an internally threaded extender;

said rotatable tuning means comprises a conductive externally threaded tuning screw having an electrically conductive threaded engagement with said extender so that said tuning screw can be received at a desired depth by said upper member; and said antenna further comprising locking means for securing said tuning screw within said upper member at said desired depth.

15. An antenna according to claim 14 wherein said locking means is an internally threaded jam nut mounted on said tuning screw.

* * * * *